US005354634A

United States Patent [19]

Misuda et al.

[11] Patent Number: 5,354,634

[45] Date of Patent: * Oct. 11, 1994

[54] ELECTROSTATIC IMAGE TRANSFER RECORDING SHEET

[75] Inventors: Katsutoshi Misuda; Nobuyuki Yokota, both of Yokohama, Japan

[73] Assignee: Asahi Glass Company Ltd., Tokyo, Japan

[ * ] Notice: The portion of the term of this patent subsequent to Apr. 3, 2009 has been disclaimed.

[21] Appl. No.: 863,585

[22] Filed: Apr. 3, 1992

[30] Foreign Application Priority Data

Apr. 5, 1991 [JP] Japan ..... 3-100347
Aug. 21, 1991 [JP] Japan ..... 3-233857

[51] Int. Cl.[5] ..... G03C 3/00

[52] U.S. Cl. ..... 430/18; 430/47; 430/48; 428/304.4

[58] Field of Search ..... 430/18, 47, 48; 428/304.4

[56] References Cited

U.S. PATENT DOCUMENTS 4,500,645 2/1985 Fuchikami et al. ..... 502/79
4,711,816 12/1987 Wittnebel ..... 428/412
4,879,166 11/1989 Misuda et al. ..... 428/212
5,104,730 4/1992 Misuda et al. ..... 428/454 X
5,185,213 2/1993 Fujita et al. ..... 428/500
5,202,205 4/1993 Malhatra ..... 430/17

FOREIGN PATENT DOCUMENTS 0240147 10/1987 European Pat. Off. .
0298424 1/1989 European Pat. Off. .

OTHER PUBLICATIONS

Patent Abstracts of Japan, vol. 15, No. 39, (M-1075), Jan. 30, 1991, & JP-A-2 276 671, Nov. 13, 1990, K. Sumita, et al., "Recording Sheet".

*Primary Examiner*—Marion E. McCamish
*Assistant Examiner*—Mark A. Chapman
*Attorney, Agent, or Firm*—Oblon, Spivak, McClelland, Maier & Neustadt

[57] ABSTRACT

An electrostatic image transfer recording sheet which comprises a substrate having, on one side thereof, an image-forming layer made of a porous alumina hydrate and, on the other side, a porous alumina hydrate layer.

12 Claims, No Drawings

ELECTROSTATIC IMAGE TRANSFER RECORDING SHEET

The present invention relates to an electrostatic image transfer recording sheet.

In recent years, color copying machines employing an electrostatic image transfer system, have been developed. According to this system, printing is conducted in such a manner that an image is optically formed on a transfer roller, then a toner composed of colorant-carrying resin particles is electrostatically adsorbed on the image, and the adsorbed toner is transferred to an image-receiving recording sheet, followed by press-fixing.

If an image is formed on a transparent substrate by the electrostatic image transfer system, such a recorded product can be used for an overhead projector (hereinafter referred to simply as OHP). Here, if a colored transparent material is used as the toner, a colored recorded product for OHP is obtainable.

A resin sheet such as a polyethylene terephthalate sheet has been used as a recording sheet for OHP. However, such a resin sheet lacks in absorptivity for a colorant, whereby a recorded product with a high color density can not be obtained. Under these circumstances, the present inventors have previously proposed a recording sheet having an alumina hydrate layer formed on a substrate e.g. in Japanese Unexamined Patent Publication No. 276670/1990.

In the electrostatic image transfer system, the recording sheet is required to have a certain specific surface resistance. Further, to fix the toner on the recording sheet, pressing is conducted by a heated roller. To facilitate peeling of the recording sheet from the roller, a lubricant is coated on the roller. as such a lubricant, silicone oil is most commonly employed.

A conventional recording sheet for OHP employs a plastic sheet as the substrate and thus is likely to be electrostatically charged. Consequently, such a recording sheet is often entrapped in a machine during an automated transfer by the machine. Further, it may happen that the sheet is stained or becomes sticky with oil from e.g. a transfer roller or a heating roller.

It is an object of the present invention to provide a recording sheet which is suitable for the machine and which is capable of presenting a recorded sheet having a high color density and high durability.

The present invention provides an electrostatic image transfer recording sheet which comprises a substrate having, on one side thereof, an image-forming layer made of a porous alumina hydrate and, on the other side, a porous alumina hydrate layer.

Now, the present invention will be described in detail with reference to the preferred embodiments.

In the present invention , the porous alumina hydrate layer on the opposite side to the image-forming layer side, imparts proper electrical conductivity and oil-absorbing properties to the sheet.

The porous alumina hydrate layer on the opposite side to the image-forming layer side, is preferably made of pseudo-boehmite (AlOOH). The porous alumina hydrate layer has pores having radii of from 10 to 100 Å, and it preferably has a pore volume of from 0.3 to 1.0 cc/g, since it then has sufficient absorbing properties and transparency. Here, if the substrate and the image-forming layer are transparent, the recording sheet will also be transparent.

In addition to these physical properties, it is preferred that the average pore radius of pores in the alumina hydrate layer is from 15 to 50 Å, and the volume of pores having radii within a range of ±10 Å of the average pore radius, is at least 45% of the total pore volume, particularly with a view to satisfying both the absorbing properties and the transparency. It is more preferred that the average pore radius is from 15 to 30 A, and the volume of pores having radii within a range of ±10 Å of the average pore radius, is at least 55% of the total pore volume. In the present invention, the pore size distribution is measured by a nitrogen absorption and desorption method.

The thickness of the alumina hydrate layer on the opposite side to the image-forming layer side is suitably selected depending upon the specification of e.g. the printer to be used. However, it is preferred to employ a thickness of from 0.5 to 50 μm for such a layer. If the thickness of the alumina hydrate layer is less than 0.5 μm, the effects of the present invention may not adequately be obtained. On the other hand, if it exceeds 50 μm, the transparency of the alumina hydrate layer may be impaired, or the strength of the layer tends to be low, such being undesirable.

To form the alumina hydrate layer on the substrate, it is possible to employ, for example, a method wherein a binder is added to alumina hydrate to obtain a slurry, and the slurry is coated on the substrate by means of e.g. a roll coater, an air knife coater, a blade coater, a rod coater, a bar coater or a comma coater, followed by drying.

As the binder, it is usually possible to employ an organic material such as starch or its modified products, polyvinyl alcohol or its modified products, SBR latex, NBR latex, carboxymethyl cellulose, hydroxymethyl cellulose or polyvinyl pyrrolidone. The binder is used preferably in an amount of from 5 to 50% by weight of the alumina hydrate. If the amount of binder is less than 5% by weight, the strength of the alumina hydrate layer tends to be inadequate. On the other hand, if it exceeds 50% by weight, the colorant-adsorbing properties tend to be inadequate.

In the present invention, there is no particular restriction as to the substrate, and various materials may be used for the substrate. Specifically, various plastics such as polyethylene terephthalate, a polyester resin such as polyester diacetate, a polycarbonate resin and a fluorine-type resin such as ETFE, or paper materials, may suitably be used. For the OHP recording sheet, the substrate is required to be transparent. However, an opaque substrate may be used for recording sheets for other purposes. Further, for the purpose of improving the adhesive strength of the alumina hydrate layer, it is possible to apply e.g. corona discharge treatment or undercoating treatment.

In the present invention, the porous alumina hydrate of the image-forming layer is preferably pseudo-boehmite (AlOOH), since the colorant will thereby be well absorbed and fixed, and the transparency will be excellent. The image-forming layer is particularly preferably porous pseudo-boehmite having an average pore radius of from 15 to 30 Å. If the average pore radius of this layer is less than 15 Å, no adequate absorptivity for a lubricant tends to be obtained, such being undesirable. On the other hand, if the average pore radius exceeds 30 Å, the surface resistance of the recording sheets tends to increase, whereby such sheets tend to electrostatically stick to one another, and jamming of recording sheets in the copying machine is likely to occur.

This layer is preferably formed to have a surface density of from 2 to 10 g/m$^2$, more preferably from 4 to 10 g/m$^2$. If the surface density is less than 2 g/m$^2$, the absorptivity for a lubricant tends to be inadequate, such being undesirable. On the other hand, if the surface density exceeds 10 g/m$^2$, no further improvement in the absorptivity for a lubricant will be obtained, and the transparency of the recording sheet tends to be impaired even when a transparent substrate is employed, and the mechanical strength of the layer is likely to deteriorate.

In the present invention, the image-forming layer preferably comprises two layers i.e. a lower layer of above-mentioned pseudo-boehmite having an average pore radius of from 15 to 30 Å and an upper layer of porous pseudo-boehmite having an average pore radius of from 35 to 100 Å, more preferably from 35 to 70 Å since it is thereby possible to readily absorb a lubricant. Accordingly, the fixing property of the toner particles will be excellent, whereby a clear image can be obtained. The relation between the lubricant and the fixing property of toner particles is not clearly understood. However, it is considered that when a lubricant layer is present between the toner and the recording sheet at the time of press fixing, it prevents the toner from uniformly fixing to the recording sheet. If the average pore radius is less than 35 Å, no adequate effects of the present invention tend to be obtained, and the lubricant-absorbing rate will not increase. When the average pore radius exceeds 100 Å, no further improvement in the effects will be obtained. On the contrary, the surface resistance increases, whereby such sheets tend to electrostatically stick to one another, and thus jamming of the sheets is likely to occur in the copying machine.

The upper layer is preferably relatively thin, and its surface density is preferably from 0.5 to 3 g/m$^2$, more preferably from 0.5 to 2 g/m$^2$. If the surface density is less than 0.5 g/m$^2$, no adequate effects of the present invention will be obtained, and the lubricant-absorbing rate will not adequately increase. If the surface density exceeds 3 g/m$^2$, the lubricant-absorbing rate will no longer increase, and the surface resistance of the recording sheets tends to increase, whereby such sheets tend to electrostatically stick to one another, whereby jamming is likely to occur.

The toner is colored fine particles composed of a colorant and a binder resin, and it may further include an antistatic charge-controlling agent and a conductivity-controlling agent, as the case requires. As the binder resin, it is preferred to employ a noncrystalline polymer having a glass transition temperature of from 50° to 70° C. Specifically, a styrene-acrylate copolymer, a styrene-butadiene copolymer, a polyester or an epoxy resin, may be mentioned. As the colorant, carbon black or magnetite is useful in the case of a black toner. For color toners, various dyes or pigments may be employed.

In the present invention, pseudo-boehmite is a xerogel of boehmite represented by the chemical formula AlOOH. Here, the pore characteristics when gelled vary depending upon the size and the shape of colloid particle of boehmite. If boehmite having a large particle size is employed, pseudo-boehmite having a large average pore radius can be obtained. Further, such boehmite layers preferably have a pore volume of from 0.3 to 1.0 cc/g from the viewpoint of the absorptivity with respect to both the upper and lower layers.

The thickness of the image-forming layer is suitably selected in accordance with the specification of e.g. the printer to be used. However, it is preferred to employ a thickness of from 0.5 to 50 μm. If the thickness of the image-forming layer is less than 0.5 μm, the colorant may not adequately be adsorbed. On the other hand, if it exceeds 50 μm, the transparency of the image-forming layer tends to be impaired, and the strength of the layer is likely to deteriorate.

When the image-forming layer comprises two layers, the thickness of the lower layer is preferably from 1.5 to 10 μm, and the thickness of the upper layer is preferably from 0.2 to 3 μm.

To form the image-forming layer on the substrate, it is possible, as in the case of the rear side, to employ a method wherein a binder is added to a boehmite sol to obtain a slurry, and the slurry is coated by means of a roll coater, an air knife coater, a blade coater, a rod coater, a bar coater or a comma coater, followed by drying. By this method, firstly, the lower layer is formed on the substrate, and preferably after the binder is sufficiently cured, the upper layer is formed.

The recording sheet of the present invention is particularly useful for a transparent sheet such as an OHP recording sheet. However, the effects of the present invention can be obtained also with an opaque sheet. Further, when a transparent substrate is used and a transparent porous alumina hydrate layer is formed on the opposite side to the image-forming layer side, the image of the image-forming layer can be observed through the transparent substrate.

Now, the present invention will be described in further detail with reference to the Examples. However, it should be understood that the present invention is by no means restricted by such specific Examples.

EXAMPLE 1

Into a glass reactor having a capacity of 2,000 cc, 900 g of water and 676 g of isopropyl alcohol were charged and heated by a mantle heater to a liquid temperature of 75° C. While stirring the mixture, 306 g of aluminum isopropoxide was added, and the mixture was hydrolyzed for 5 hours while maintaining the liquid temperature to a level of from 75° to 78° C. Then, the temperature was raised to 95° C., and 9 g of acetic acid was added thereto. The mixture was maintained at a temperature of from 75° to 78° C. for 48 hours for deflocculation. This liquid was further concentrated to 900 g to obtain a white sol. The dried product of this sol was pseudo-boehmite which had an average pore radius of 27 Å.

To 5 parts by weight of this alumina sol, 1 part by weight of polyvinyl alcohol was added. Water was further added thereto to obtain a slurry having a solid content of about 10%. This slurry was coated on a sheet substrate of polyethylene terephthalate (thickness: 100 μm) treated by corona discharge treatment, by means of a bar coater so that the layer thickness when dried would be 10 μm, followed by drying. Then, to the opposite side the same alumina sol was coated in the same manner so that the layer thickness when dried would be 5 μm, followed by drying, to obtain a recording sheet. The average pore radius of the alumina hydrate layer formed on the substrate was 20 Å, and the volume of pores having pore radii of from 10 to 30 Å was 60% of the total pore volume.

To the above recording sheet, red, yellow and blue solid patterns were continuously printed by means of an electrostatic image transfer system electrophotographic digital copying machine (Picsel DIO, manufactured by Canon Inc.). From the rear side of the printed side of the recording sheet, the printed portion where printed patterns are overlapped was inspected, whereby no sticky appearance was observed. After printing, recording films were left in an overlaid state for three hours, and then the films were peeled from each other, whereby they were easily peeled. There was no sticky appearance observed at the printed portion.

EXAMPLE 2

To 5 parts by weight of the alumina sol as used in Example 1, 1 part by weight of polyvinyl alcohol was added, and water was further added thereto to obtain a slurry having a solid content of about 10%. This slurry was coated on a sheet substrate of polyethylene terephthalate (thickness: 100 μm) treated by corona discharge treatment, by means of a bar coater so that the surface density would be 6 g/m$^2$, followed by drying.

Then, into a glass reactor having a capacity of 2,000 cc, 720 g of water and 676 g of isopropanol were charged and heated by a mantle heater to a liquid temperature of 75° C. While stirring the mixture, 306 g of aluminum isopropoxide was added. The mixture was hydrolyzed for four hours while maintaining the liquid temperature to a level of from 75° to 78° C. Then, the temperature was raised to 95° C., and 9 g of acetic acid was added. The mixture was maintained at a temperature of from 75° to 78° C. for 48 hours for deflocculation. This liquid was further concentrated to 900 g to obtain a white sol. The dried product of this sol was pseudo-boehmite, which had an average pore radius of 50 Å.

To 5 parts by weight of this alumina sol, 1 part by weight of polyvinyl alcohol was added, and water was further added thereto to obtain a slurry having a solid content of 10% by weight. This slurry was coated on the previously formed porous pseudo-boehmite layer having an average pore radius of 27 Å, by means of a bar coater so that the surface density would be 1 g/m$^2$, followed by drying.

As a result, a recording sheet having pseudo-boehmite having an average pore radius of 50 Å laminated on a pseudo-boehmite layer having an average pore radius of 27 Å formed on a substrate, was obtained. On the rear side of this recording sheet, a pseudo-boehmite layer having an average pore radius of 27 Å was coated so that the layer thickness when dried would be 5 μm, followed by drying, in the same manner as in Example 1.

To this recording sheet, a yellow solid printing was conducted by a toner having an average particle diameter of about 10 μm by means of an electrostatic image transfer system electrophotographic color copying machine (Picsel DIO, manufactured by Canon Inc.). With respect to this recorded product, the chroma at a brightness index 95 was measured and found to be 28. A transmittance type colorimeter (CT-210, manufactured by Minolta Camera Co., Ltd.) was used for the measurement of the brightness index and the chroma. With respect to the chroma, the larger the numerical value, the clearer the color.

With respect to the recording sheet prepared in Example 1, the chroma was measured in the same manner and was found to be 20.

With the recording sheet of the present invention, the electrostatic chargeability can be controlled, whereby jamming in the machine can be reduced. Further, the porous alumina hydrate layer absorbs oil from e.g. a transfer roller or a heating roller, and the recording sheet is free from stickiness or staining. Further, even when recording sheets were left in an overlaid state, they do not stick to each other. Therefore, with this recording sheet, continuous printing by a machine can be conducted to obtain a recorded product under a constant condition.

The recording sheet of the present invention is suitable for use as a recording sheet for an electrostatic image transfer system, particularly for a color electrostatic image transfer system. The recording sheet of the present invention has a proper surface resistance and thus is free from such a problem that the sheet electrostatically sticks to cause jamming in a copying machine. Further, the recording sheet has excellent absorptivity for a lubricant, the fixing property of a toner is excellent, and a clear record is obtainable.

We claim:

1. An electrostatic image transfer recording sheet which comprises a substrate having, on one side thereof, an image forming layer constituted of a porous alumina hydrate in a binder and on the other side, a layer of porous alumina hydrate in a binder, wherein in each of said layers, the amount of binder ranges from 5 to 50% by wt of the alumina hydrate.

2. The electrostatic image transfer recording sheet according to claim 1, wherein the porous alumina hydrate layer on the opposite side to the image-forming layer side, is made of pseudo-boehmite.

3. The electrostatic image transfer recording sheet according to claim 1, wherein the porous alumina hydrate of the image-forming layer is pseudo-boehmite.

4. The electrostatic image transfer recording sheet according to claim 3, wherein the porous alumina hydrate of the image-forming layer is porous pseudo-boehmite having an average pore radius of from 15 to 30 Å.

5. The electrostatic image transfer recording sheet according to claim 1, wherein the image-forming layer comprises a lower layer made of porous pseudo-boehmite having an average pore radius of from 15 to 30 Å and an upper layer made of porous pseudo-boehmite having an average pore radius of from 35 to 100 Å.

6. The electrostatic image transfer recording sheet according to claim 5, wherein the lower layer has a surface density of from 2 to 10 g/m$^2$, and the upper layer has a surface density of from 0.5 to 3 g/m$^2$.

7. The electrostatic image transfer recording sheet according to claim 5, wherein the lower layer has a surface density of from 4 to 10 g/m$^2$, and the upper layer has a surface density of from 0.5 to 2 g/m$^2$.

8. The electrostatic image transfer recording sheet according to claim 1, wherein the substrate is transparent.

9. The electrostatic image transfer recording sheet according to claim 1, wherein the substrate is made of polyethylene terephthalate.

10. A recorded product comprising an electrostatic image transfer recording sheet of claim 1 having an electrostatic image transfer toner spreaded thereon.

11. The electrostatic image transfer recording sheet according to claim 1, wherein each of said image-forming layer and the alumina hydrate layer on the opposite side to the image-forming layer has a thickness of from 0.5 to 50 μm.

12. The electrostatic image transfer recording sheet according to claim 1, wherein said image-forming layer comprises two layers, the lower having a thickness of from 1.5 to 10 μm while the thickness of the upper layer is from 0.2 to 3 μm.

* * * * *

UNITED STATES PATENT AND TRADEMARK OFFICE

CERTIFICATE OF CORRECTION

PATENT NO. : 5,354,634

DATED : October 11, 1994

INVENTOR(S) : Katsutoshi MISUDA, et al.

It is certified that error appears in the above-indentified patent and that said Letters Patent is hereby corrected as shown below:

On the title page, Item [*], the Terminal Disclaimer date is listed incorrectly. It should read:

--Apr. 14, 2009--

Signed and Sealed this

Fourth Day of April, 1995

*Attest:*

BRUCE LEHMAN

*Attesting Officer*

*Commissioner of Patents and Trademarks*